United States Patent [19]

Vertes

[11] 4,279,351

[45] Jul. 21, 1981

[54] CONTAINER CAP

[76] Inventor: Michael A. Vertes, 20 Tubbs Spring Ct., Weston, Conn. 06883

[21] Appl. No.: 169,433

[22] Filed: Jul. 16, 1980

Related U.S. Application Data

[62] Division of Ser. No. 956,504, Nov. 1, 1978, Pat. No. 4,215,786.

[51] Int. Cl.[3] ..... B65D 51/26

[52] U.S. Cl. ..... 215/231

[58] Field of Search ..... 215/228, 231, 11 R, 215/6; 206/591

[56] References Cited

U.S. PATENT DOCUMENTS 2,941,689 6/1960 Black ..... 215/6 X 3,163,544 12/1964 Valyi ..... 215/6 X 3,169,654 2/1965 Pollklesener ..... 215/231

FOREIGN PATENT DOCUMENTS 2628296 12/1977 Fed. Rep. of Germany ..... 215/231

*Primary Examiner*—George T. Hall

*Attorney, Agent, or Firm*—Marvin Feldman; Stephen E. Feldman

[57] ABSTRACT

A container cap for a pill container is disclosed wherein the cap provides protection against pill degradation through shaking as well as moisture exposure. The cap is of an integral one-piece construction. A particularly useful application is in the low cost cylindrical thermoplastic pill containers, where the aforesaid protection is necessary without multi-piece construction.

6 Claims, 5 Drawing Figures

CONTAINER CAP

This is a division, of application Ser. No. 956,504 filed Nov. 1, 1978, now U.S. Pat. No. 4,215,786.

FIELD OF THE INVENTION

This invention relates to container caps. Specifically this invention relates to caps for use with containers for solid materials such as pills.

BACKGROUND AND DISCUSSION OF PRIOR ART

Heretofore in the prior art it was known to provide a cap insert with a groove for engaging the lip of the container such that when the cap was tightened down, the insert would form a vapor-tight seal with the container, thus protecting the contents of the container against ambient moisture.

It was also known in the prior art, that to protect pills in a container from breaking as a result of vibration, cotton or other soft, flexible materials would be placed on top of the pills and wedged between the cap and the pills. While the cotton served its intended purpose, it was subject to being misplaced or damaged by the user in repeated pill takings, such that after a certain time the residual pills remained in the container without the cotton.

There is now provided by the present invention a unitary container cap which provides both a vapor-seal while simultaneously protecting the contents against damage through shaking, and in a preferred aspect serves as the overcap as well to lock to the container.

It is therefore a principal object of this invention to provide a container cap which is multi-functional.

It is another principal object of this invention to provide a container cap which eliminates the need for multiple container and cap inserts.

It is another object of this invention to provide a container cap as aforesaid which is of unitary construction.

It is another object of this invention to provide a pill container cap which simultaneously provide pill protection against breakage as well as moisture degration.

It is still a further object of this invention to provide a container cap as aforesaid which further locks to the container body.

It is a still further object of this invention to provide a container cap which is readily manufactured of relatively inexpensive materials and yet is safe and practical in use.

The aforesaid as well as other objects and advantages as well become apparent from a reading of the following description, the adjoined claims, and the drawings in which:

DESCRIPTION OF THE PREFERRED EMBODIMENT

Figure 1:
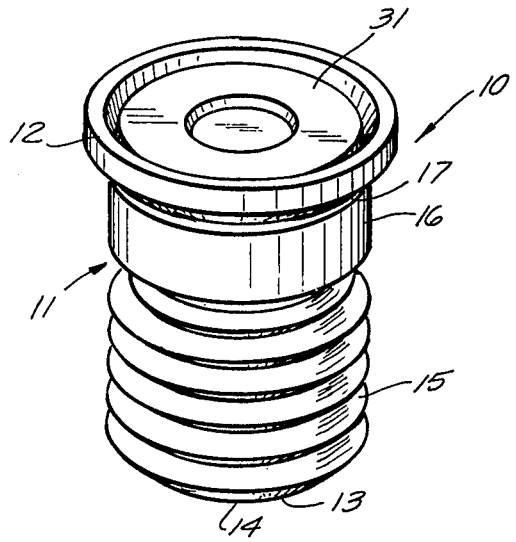
FIG. 1 is a perspective view of the container cap of this invention.
Figure 2:
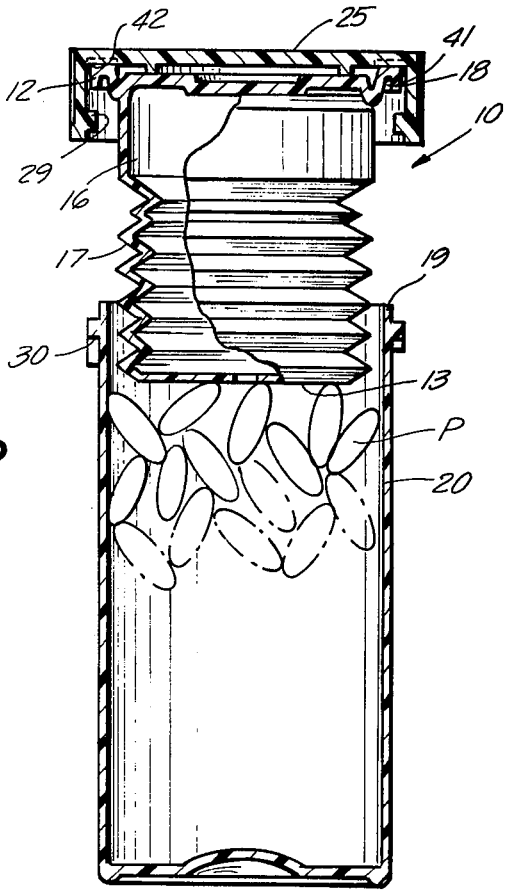
FIG. 2 is a partial sectional view of the cap of this invention being inserted into a pill container.
Figure 3:
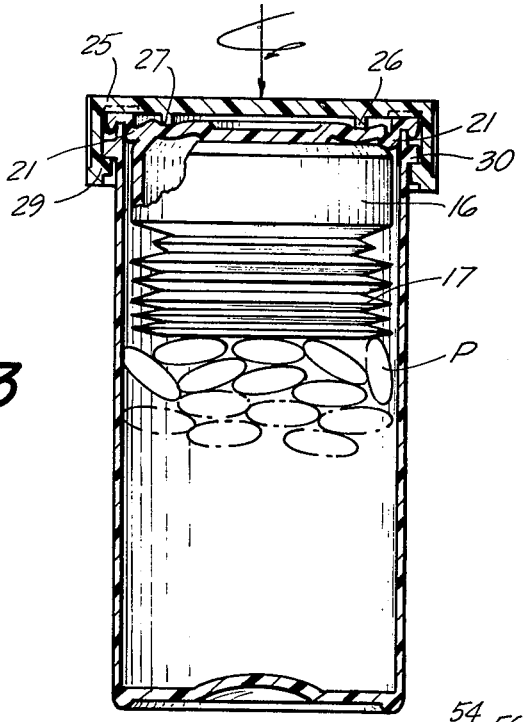
FIG. 3 is a sectional view of the cap of this invention locked into a pill container.

Referring to FIGS. 1–3, there is shown the container cap of this invention generally referred to as numeral 10. Cap 10 comprises a generally cylindrical body portion 11 and a top circular flange 12 integral therewith and coaxially disposed thereto. Body portion 11 comprises a bottom wall 13 having a central hole 14; a flexible bellows 15 extending upwardly from the bottom wall; and a tubular portion 16 extending from the bellows portion to the bottom 17 of flange 12.

To permit the expansion and contraction of bellows 17, air is permitted to flow through the bellows. Flange 12 is formed with a central plate portion 31 which seals off the interior of the bellows.

Tubular portion 16 unlike bellows 17 is non-retractable and non-extensible, and the length of the tubular portion determines in effect the maximum height of the material in the container.

Flange 12 is formed with an annular groove 18 for engaging the lip 19 of container 20. Groove 18 forms a circumfrential air-tight seal as at 21. Overcap 25 is formed with an annular projection 26 for interengaging annular surface 27 in the top 28 of flange 12. Overcap 25 and flange 12 or more specifically flange peripheral surface 41, are correspondingly sized so that, flange 12 fits snugly and is retained in recess 42 of the overcap 25. Overcap 25 is also formed with lugs 29 for engaging protruding lugs 30 of container 20 containing pills P for locking the overcap 25. In this manner of construction the flange 12 is mounted within the overcap 25, and sealed to the container as at 21, and locked in place by locking lugs 29, 30.

Figure 4:
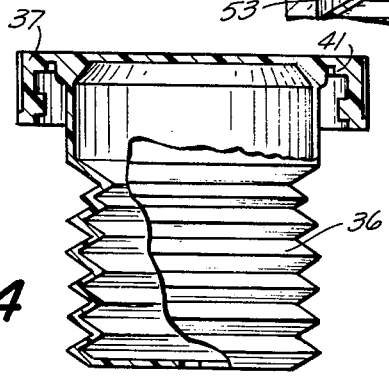
FIG. 4 is a partial sectional view of an alternate embodiment of the invention.

Referring to FIG. 4, there is shown an alternate embodiment generally referred to as numeral 35. Cap 35 is of an integral, one-piece construction with combined bellows 36 and flange 37, as well as locking lug 40 to engage the sides of the container as in the aforesaid embodiment. Thusly, the one-piece construction 35 provides protection against damage from both moisture and rattling, as well as safety locking.

Figure 5:
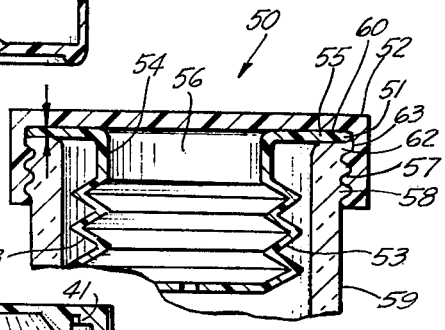
FIG. 5 is a partial sectional view of another embodiment.

Referring to FIG. 5, there is shown an alternate embodiment 50, which comprises a cap 51 and an overcap 52. Cap 51 is formed with a bellows portion 53, and integral tubular portion 54 as in the aforedescribed embodiment. Cap 51 is also formed with an annular flange 55 extending outwardly from the tubular portion and providing a central opening 56. Annular flange 55 is of compressible material. Overcap 52 is of conventional construction with internal threads 57 formed to engage threads 58 of glass vial 59. With the threading of overcap 52, the flange 55 is compressed between overcap surface 60 and lip 61 of vial 59 so as to provide air-tight seals at 62 and 63, thereby protecting the material within the vial.

The caps of the present invention, as exemplified by construction 10, 35 and 51 heretofore described, may be formed of injection blow-molded thermoplastic construction. To achieve same a core rod may be injection-molded with a parison wherein the outward end of the parison is injection molded to form the detailed construction elements to the flange and fixed in that shape while the body portion of the parison while still thermoplastic can be blow-molded to form the bellows and tubular body portions. The hole in the bottom wall of the bellows would be formed by the diameter of the core rod. While in the blow-mold, the formed flange can be held in place by the mold walls.

In an alternate mode of manufacture the flange, tubular portion and bellows without a bottom wall can be injection molded with the sprue emanating from the top central portion of the flange. After injection molding the bottom bellows wall would be thermoplastically welded to the bellows to complete the construction.

The preferred mode of manufacture is by injection blow molding.

Suitable thermoplastics useful pursuant to the present invention include by way of example, the polyolefins (e.g. polyethylene, polypropylene); polyvinyls (e.g. PVC, PVA); polystyrene; and the like. Flexible and elastomeric thermoplastics are particularly desirable.

The container useful in combination with the caps of this invention include both glass as well as plastic. It is particularly desirable to provide the low cost cap in combination with a low cost plastic pill container.

While there has been described specific preferred embodiments of the invention, various modifications may be made without departing from the scope of the invention as defined by the adjoined claims.

What is claimed is:

1. A container cap comprising a one-piece construction comprising a bellows and flange means integrally formed with and extending radially outwardly therefrom, and extending across the top of the container, further comprising a hollow cylindrical portion integrally connected at one end to the bellows and at the other end to the flange means, said flange means comprising means to engage the lip of a container so as to form a seal thereat with the bellows disposed within the container adjacent the container wall, whereby the bellows expands and contracts to contact the material within the container to limit movement thereof.

2. The cap of claim 1, said means to engage the lip further comprises means to engage the outside of the container.

3. The cap of claim 2, said means to engage the outside of the container comprising means cooperatively associated with the container to lock the cap to the container.

4. The cap of claim 1, wherein said flange means is formed as a plate which covers the bellows.

5. The cap of claim 4, wherein the bellows further comprises a bottom wall for contacting the material in the container and said bottom wall being formed with an orifice to permit expansion and contraction of the bellows.

6. A container cap comprising a one-piece injection blow molded construction comprising an injection molded flange and an injection blow-molded bellows, said bellows being formed with a hole at the bottom thereof and being integrally formed with the flange at the top thereof, said flange extending radially outwardly from the bellows, said flange comprising means to engage the lip of a container for forming a seal thereat with the bellows disposed within the container, whereby the bottom of the bellows expands and contracts to contact the material within the container to limit movement thereof.

* * * * *